US007352270B1

(12) United States Patent
Copeland

(10) Patent No.: US 7,352,270 B1
(45) Date of Patent: Apr. 1, 2008

(54) PRINTED CIRCUIT BOARD WITH MAGNETIC ASSEMBLY

(75) Inventor: Curtis S. Copeland, Springfield, MA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/553,502

(22) Filed: Oct. 27, 2006

(51) Int. Cl.
*H01F 5/00* (2006.01)

(52) U.S. Cl. ..... 336/200; 336/172

(58) Field of Classification Search ..... 336/200
See application file for complete search history.

(56) References Cited

U.S. PATENT DOCUMENTS

| | | | | |
|---|---|---|---|---|
| 4,080,585 | A | 3/1978 | Molthen | |
| 4,665,357 | A | 5/1987 | Herbert | |
| 5,777,539 | A | 7/1998 | Folker et al. | |
| 5,847,947 | A | 12/1998 | Pan et al. | |
| 6,114,949 | A | 9/2000 | Schmitz et al. | |
| 6,148,500 | A * | 11/2000 | Krone et al. | 29/602.1 |
| 6,420,953 | B1 | 7/2002 | Dadafshar | |
| 6,466,454 | B1 * | 10/2002 | Jitaru | 361/836 |
| 6,583,705 | B2 | 6/2003 | Schutten et al. | |
| 6,888,438 | B2 | 5/2005 | Hui et al. | |
| 7,005,955 | B2 | 2/2006 | Schumacher | |
| 2002/0186116 | A1 | 12/2002 | Lee | |
| 2005/0046535 | A1 | 3/2005 | Chiu et al. | |
| 2005/0195060 | A1 | 9/2005 | Chiang et al. | |

FOREIGN PATENT DOCUMENTS

| | | | |
|---|---|---|---|
| EP | 0782154 | | 7/1997 |
| JP | 59014618 | A * | 1/1984 |
| JP | 1289225 | | 11/1989 |
| JP | 4144212 | | 5/1992 |
| JP | 4235596 | | 8/1992 |
| JP | 2002367827 | | 12/2002 |
| WO | WO0232198 | | 4/2002 |
| WO | WO02049048 | | 6/2002 |
| WO | WO2006063081 | | 6/2006 |

OTHER PUBLICATIONS

PCB racetrack fluxgate sensor with improved temperature stability, J. Kubik et al., Sensors and Actuators A (Physical), Aug. 14, 2006, pp. 184-188, Switzerland.

(Continued)

*Primary Examiner*—Elvin Enad
*Assistant Examiner*—Joselito S. Baisa
(74) *Attorney, Agent, or Firm*—Cantor Colburn LLP

(57) ABSTRACT

A magnetic assembly including a printed circuit board and a core made from magnetically permeable material positioned on the printed circuit board. Plated through holes are formed in the printed circuit board, a first plated through hole on a first side of the core, a second plated through on a second side of the core and third plated though hole on the first side of the core. A winding lead has a first leg soldered in the first plated through hole and a second leg soldered in the second plated through hole, the winding lead being a discrete electrical conductor separate from the printed circuit board. A conductive trace is formed in the printed circuit board, the conductive trace electrically connected the second plated through hole and the third plated through hole.

5 Claims, 2 Drawing Sheets

OTHER PUBLICATIONS

Planar fluxgate current sensor integrated in printed circuit board, T O'Donnell et al., Sensors and Actuators A (Physical), May 24, 2006, pp. 20-24, Switzerland.
A Method to Control EMI Noises Generated by Micro-Surges Appearing at Terminals of Electric Machines Connected to Power Converters Via Electric Power Wirings, N. Mutoh et al., APEC 2004. Nineteen Annual IEEE Applied Power Electronics Conference and Exposition, 2004, pp. 701-707, USA.
Design, Manufacture and Application of In-board Magnetic Devices, Y. E. Zhang et al., Conf. Proc. IPEMC Int. Power Electron. and Motion Control Conf., 2004, pp. 1791-1798, USA.
In-board Magnetic Devices, Yi Zhang, University of California at Berkeley, 2003, 110 pgs., USA.
Interconnected nanowire clusters in polymide for flexible circuits and magnetic sensing applications, Lindeberg et al., Sensors and Actuators A (Physical), Jul. 15, 2003, pp. 150-161, Switzerland.
Improving Signal Integrity in Circuit Boards by Incorporating Embedded Edge Terminations, Adsure et al., IEEE Transactions on Advanced Packaging, Feb. 2002, pp. 12-17, USA.
Novel Eddy Current Testing Sensor for the Inspection of Printed Circuit Boards, Kacprzak et al., IEEE Transactions on Magnetics, Jul. 2002, pp. 2010-2012, Japan.
In-Board Magnetics Processes, Zhang et al., 30th Annual IEEE Power Electronics Specialists Conference. Record., 1999, pp. 561-567, USA.
Routes to Embedded Inductors in MCM-L Technology—Design, CAD and Manufacturing Issues, O"Reilly et al., Proceedings of the SPIE—The International Society for Optical Engineering, 1999, pp. 435-440, Ireland.
High Frequence Transmission Line Transformer for DC/DC Converters, Dalal et al., PESC 95 Record. 26th Annual IEEE Power Electronics Specialists Conference, 1995, pp. 671-677, USA.

* cited by examiner

PRINTED CIRCUIT BOARD WITH MAGNETIC ASSEMBLY

BACKGROUND OF THE INVENTION

Embodiments relate generally to magnetic devices, and in particular to a magnetic assembly formed on a printed circuit board.

Magnetic devices come in a variety of forms. For example, uncut toroidal-core wound magnetic devices (transformers, inductors, saturable reactors) are typically wire wound by either hand or mechanical means utilizing a wire shuttle. These assemblies are then self-leaded, potted, or mounted in carriers. These higher level assemblies are then integrated into the intended application.

Alternatively, magnetic devices can be based on separable magnetic structures. These include "E", "U", "cut toroid", "tape-wound", and "pot" cores or laminations. These structures typically use bobbins or coil formers. The copper wire is wound on the bobbin, and the core pieces are assembled around the bobbin and/or winding(s). Printed circuit boards can also be assembled within windows in the structure to form windings.

Both separable core geometries and carrier-mounted toroid assemblies require their bobbins or carriers and/or leads to bear the mass of the entire assembly. Therefore in rugged applications, the printed circuit pads and traces, the bobbin, the self-leads, and/or the solder joints are critical failure locations. Common failure modes for these joints include printed circuit board tearing/delamination and solder joint cracking through tension and bending. Leads may also be bent and torn.

The winding window of an uncut toroid core is geometrically and permanently closed. Therefore, in assembly, the conductor must be repeatedly passed through the winding window. This requires working with long pre-cut lengths of conductor, special winding machines, work-hardening of the conductor, post-assembly annealing of conductor material through heat treating processes. All of the above assembly steps add time and cost to the finished assembly.

Most copper losses are conducted through the electrical contacts of alternative magnetic device assemblies. In typical arrangements, heat is only transferred through convection (natural or forced air), or via conduction through thermally-conductive properties of electrical insulator materials (bobbins, varnishes, potting compounds). Direct conduction of heat from magnetic cores can be accomplished in some geometries. Dissipating the heat generated by the core and windings of a magnetic device strictly through convection or conduction through electrical insulator materials is inefficient, and can lead to excessive internal temperatures and thermal gradients throughout the device. Separable core geometries employing a localized air-gap have localized heat dissipation, which makes them undesirable in high-temperature, high-reliability applications.

There is a need in the art for a rugged magnetic assembly having improved heat dissipation.

BRIEF SUMMARY OF THE INVENTION

The shortcomings of the prior art are overcome and additional advantages are provided through the provision of a magnetic assembly.

An embodiment of the invention is a magnetic assembly including a printed circuit board and a core made from magnetically permeable material positioned on the printed circuit board. Plated through holes are formed in the printed circuit board, a first plated through hole on a first side of the core, a second plated through on a second side of the core and third plated though hole on the first side of the core. A winding lead has a first leg soldered in the first plated through hole and a second leg soldered in the second plated through hole, the winding lead being a discrete electrical conductor separate from the printed circuit board. A conductive trace is formed in the printed circuit board, the conductive trace electrically connecting the second plated through hole and the third plated through hole.

Additional features and advantages are realized through the techniques of the present invention. Other embodiments and aspects of the invention are described in detail herein and are considered a part of the claimed invention. For a better understanding of the invention with advantages and features, refer to the description and to the drawings.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 1:
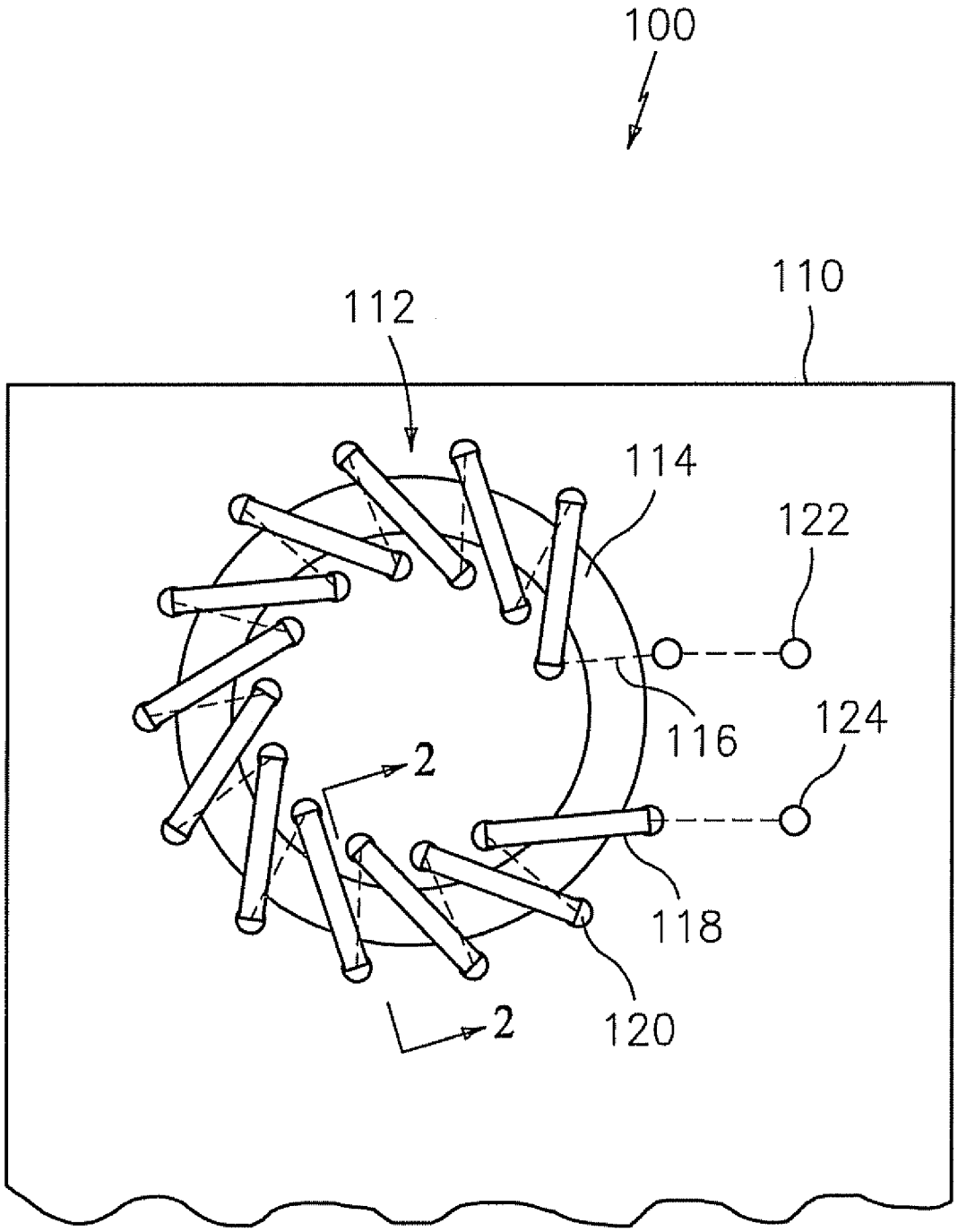
FIG. 1 depicts a top view of an exemplary magnetic assembly.

FIG. 1 shows a top view of a magnetic assembly 100 in exemplary embodiments of the invention. The magnetic assembly 100 includes a printed circuit board (PCB) 110 having mounted thereon a magnetic device. In the example shown in FIG. 1, the magnetic device 112 includes a core 114 positioned on a surface of the PCB 110. The core 114 in FIG. 1 is toroidal, but it is understood that cores of other geometries may be used, including two-piece cores, cores with air gaps, laminations, etc. The core 114 may be made from a hard or soft magnetically permeable material, including, for example, alloys of nickel, iron, molybdenum, cobalt, and aluminum.

The windings around the core 114 are formed by circuit traces 116 and winding leads 118. A number of PCB contacts 120 are positioned adjacent to, and on opposite sides of, the core 114. The PCB contacts in FIG. 1 are plated through holes. It is understood that other PCB contacts may be used, such a surface mount pads, etc. Winding leads 118 are discrete, u-shaped elements made from a conductive material (e.g., copper) and straddle the core 114. Winding leads may be drawn, formed, or stamped to a shape that corresponds to an outer surface of the core 114. Traces 116 electrically connect plated through holes 120 that are not connected by winding leads 118.

The winding around the core 114 is formed by the winding leads 118 passing over the core 114 and the traces 116 passing under the core 114. A winding lead 118 extends from a first plated through hole on a first side of the core 114 to a second plated through hole on a second side of the core 114. A trace 116 extends under the core 114 from the second plated through hole to a third plated through on the first side of the core. This pattern continues to define a winding surrounding core 114. Input and output through holes 122 and 124 are connected to the winding through traces on the PCB 110.

Figure 2:
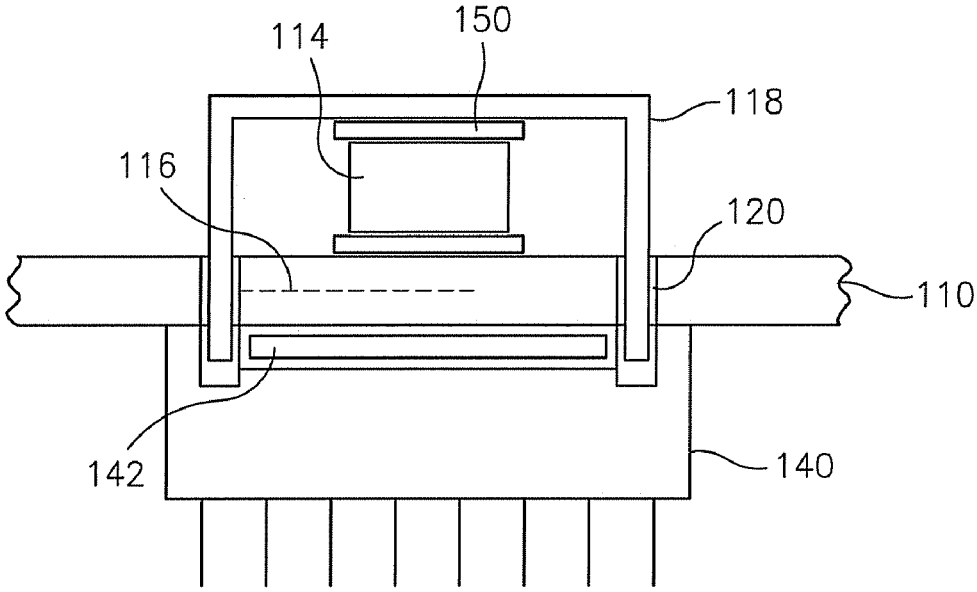
FIG. 2 is a cross-sectional view of the magnetic assembly.

FIG. 2 is a cross-sectional view of the magnetic assembly taken along line 2-2 of FIG. 1. As shown in FIG. 2, the u-shaped winding lead 118 extends over the core 114 and legs of winding lead 118 are soldered in plated through holes 120. The winding leads 118 may be in direct tension over the surface of core 114, and the shear strength of a through-hole solder joint secures the mechanical connection. In this construction, the core 114 is held firmly to PCB 110 by all the winding leads 118 equally. This provides a rugged design less prone to failure as the load of the core is distributed over many winding leads 118.

Figure 3:
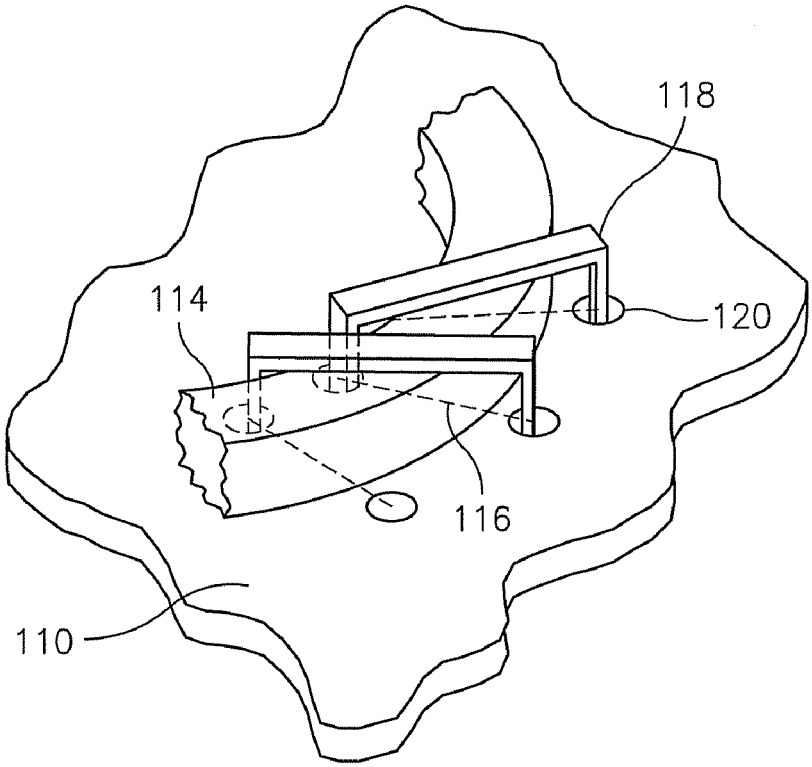
FIG. 3 is a perspective view of the magnetic assembly.

A heat sink 140 may be positioned on the opposite side of PCB 110 under the core 114 to conduct heat away from the magnetic assembly. Heat sink 140 may have channels 142 formed therein to receive the ends of the legs of winding lead 118 extending beyond PCB 110. The core 114 and/or the PCB 110 may be cushioned by a spacer 150 positioned above and/or below the core 114. The spacer 150 may be made from hard or soft materials, such as room-temperature vulcanizing (RTV) silicones, epoxies, composite gap filler pads, etc. FIG. 3 is a cutaway perspective view of the magnetic assembly 100.

Winding leads 118 can be generated from bus wire, magnet wire, stampings, or other stock. No auxiliary materials such (potting forms, bobbins, carriers, potting compound, varnish, tape, etc.) are required for a low-cost and robust magnetic assembly. Standard wave solder, selective solder (e.g., fountain) or hand soldering techniques can be utilized to join legs of winding leads 118 to plated through holes 120.

Heat may be removed from the finished assembly core 114 and windings through conventional convection and PCB conduction devices. In addition, heat is conducted directly from the core to the windings through direct contact with circuit board traces 116. This PCB 110 may be constructed such that there are multiple thermally conductive paths between external surfaces and traces 116. Thermal vias populating traces 116 conduct heat to the bottom surface of the printed circuit board 110, where it is removed via a conduction, radiation, or convection. Examples of radiation/convection devices include a large surface area of secondary side copper, surface-mounted heat sinks, or mechanical integration of an external heat sink or conductive surface via gap pads, thermal grease, etc. FIG. 2 depicts a gap pad 142 between PCB 110 and heat sink 140.

While the invention has been described with reference to exemplary embodiments, it will be understood by those skilled in the art that various changes may be made and equivalents may be substituted for elements thereof without departing from the essential scope thereof. Therefore, it is intended that the invention not be limited to the particular embodiments disclosed for carrying out the invention, but that the invention will include all embodiments falling within the scope of the appended claims.

What is claimed is:

1. A magnetic assembly comprising:

a printed circuit board;

a core made from magnetically permeable material positioned on the printed circuit board;

plated through holes formed in the printed circuit board, a first plated through hole on a first side of the core, a second plated through hole on a second side of the core and third plated through hole on the first side of the core;

a winding lead having a first leg soldered in the first plated through hole and a second leg soldered in the second plated through hole, the winding lead being a discrete electrical conductor separate from the printed circuit board, the first leg extending through and beyond the printed circuit board opposite the core and the second leg extending through and beyond the printed circuit board opposite the core;

a conductive trace formed in the printed circuit board, the conductive trace electrically connecting the second plated through hole and the third plated through hole; and a heat sink positioned on the printed circuit board opposite the core, the heat sink including a first recessed channel for receiving the first leg extending beyond the printed circuit board opposite the core, the heat sink including a second recessed channel for receiving the second leg extending beyond the printed circuit board opposite the core.

2. The magnetic assembly of claim 1 further comprising:

a plurality of winding leads and a plurality of conductive traces, the winding leads and conductive traces forming a winding encompassing the core.

3. The magnetic assembly of claim 1 further comprising:

a spacer positioned between the printed circuit board and the core.

4. The magnetic assembly of claim 1 further comprising:

a spacer positioned between the winding lead and the core.

5. The magnetic assembly of claim 1 further comprising:

a plurality of thermal vias in the printed circuit board, the thermal vias conducting heat from the core to the heat sink.

* * * * *